US006672827B2

(12) United States Patent
Yamashita et al.

(10) Patent No.: US 6,672,827 B2
(45) Date of Patent: Jan. 6, 2004

(54) VACUUM PUMP

(75) Inventors: Yoshihiro Yamashita, Chiba (JP); Manabu Nonaka, Chiba (JP); Takashi Kabasawa, Chiba (JP)

(73) Assignee: Seiko Instruments Inc. (JP)

( * ) Notice: Subject to any disclaimer, the term of this patent is extended or adjusted under 35 U.S.C. 154(b) by 6 days.

(21) Appl. No.: 10/016,590

(22) Filed: Oct. 30, 2001

(65) Prior Publication Data

US 2002/0122729 A1 Sep. 5, 2002

(30) Foreign Application Priority Data

Oct. 31, 2000 (JP) ..... 2000-331852

(51) Int. Cl.[7] ..... F04D 19/04
(52) U.S. Cl. ..... 415/90; 415/143; 417/423.4
(58) Field of Search ..... 415/90, 143; 417/423.4

(56) References Cited

U.S. PATENT DOCUMENTS

| | | | | |
|---|---|---|---|---|
| 3,969,039 A | | 7/1976 | Shoulders | |
| 4,978,276 A | | 12/1990 | Kabelitz et al. | |
| 6,106,223 A | * | 8/2000 | Leyshon | 415/90 |
| 6,422,829 B1 | * | 7/2002 | Schutz | 415/90 |
| 6,435,811 B1 | * | 8/2002 | Beyer et al. | 415/90 |

FOREIGN PATENT DOCUMENTS

| | | | | |
|---|---|---|---|---|
| EP | 0874159 | | 10/1998 | |
| JP | 61-145394 A | * | 7/1986 | 415/90 |
| JP | 63-55396 A | * | 3/1988 | 415/90 |
| JP | 63-192987 A | * | 8/1988 | 417/423.4 |
| WO | WO-99/15793 A1 | * | 4/1999 | 415/90 |

* cited by examiner

*Primary Examiner*—Christopher Verdier
(74) *Attorney, Agent, or Firm*—Adams & Wilks

(57) ABSTRACT

To provide a small vacuum pump making it possible to efficiently perform evacuation from the atmosphere to a high vacuum (degree of vacuum: $10^{-5}$ Pa) by using a single pump unit. A turbo-molecular pump mechanism portion is arranged on the high-vacuum side, a volute pump mechanism portion is arranged on the atmosphere side, and a thread groove pump mechanism portion is arranged between the turbo-molecular pump mechanism portion and the volute pump mechanism portion. Further, rotor blades of the turbo-molecular pump mechanism portion, a rotor of the thread groove pump mechanism portion, and an impeller of the volute pump mechanism portion are integrally mounted to a single rotor shaft, which is rotated by a single motor.

11 Claims, 2 Drawing Sheets

VACUUM PUMP

BACKGROUND OF THE INVENTION

1. Field of the Invention

The present invention relates to a vacuum pump for use in a semiconductor manufacturing apparatus, an electron microscope, a surface analysis apparatus, a mass spectrograph, a particle accelerator, a nuclear fusion experiment apparatus, etc.

2. Description of the Related Art

Conventionally, in a semiconductor manufacturing apparatus, for example, operations, such as etching and sputtering, are performed in a high-vacuum semiconductor process chamber. Generally speaking, to create a high vacuum from atmosphere in a container of such a semiconductor process chamber, a combination of a high-vacuum pump and a low-vacuum pump is adopted. However, since each of the two pumps are rather large, they are hard to be integrated with each other, and it is impossible to unite them into a single small vacuum pump.

Japanese Patent Laid-open No. 88624/1985 discloses a known vacuum pump in which it is possible to effect evacuation from the atmospheric pressure to the molecular flow range with a single pump. In the vacuum pump disclosed in this publication, however, an open-type impeller is used, so that it is only possible to achieve a degree of vacuum of approximately $10^{-3}$ Pa. Further, a high evacuation rate cannot be achieved at a pressure close to the atmospheric pressure.

The present invention has been made with a view to solving the above problems. It is an object of the present invention to provide a small vacuum pump which makes it possible to efficiently create a high vacuum (degree of vacuum: $10^{-5}$ Pa) from the atmosphere by using a single unit of this pump.

SUMMARY OF THE INVENTION

To achieve the above object, there is provided, in accordance with the present invention, a vacuum pump including a turbo-molecular pump mechanism portion performing an evacuating operation through interaction between rotating rotor blades and stationary stator blades, a thread groove pump mechanism portion performing an evacuating operation through interaction between a rotating rotor and a thread groove, and a volute pump mechanism portion performing an evacuating operation through rotation of a volute impeller, wherein the turbo-molecular pump mechanism portion is arranged on a high vacuum side, the volute pump mechanism portion is arranged on an atmosphere side, and the thread groove pump mechanism portion is arranged between the turbo-molecular pump mechanism portion and the volute pump mechanism portion.

Further, in accordance with the present invention, there is provided a vacuum pump characterized in that the rotor blades of the turbo-molecular pump mechanism portion, the rotor of the thread groove pump mechanism portion, and the impeller of the volute pump mechanism portion are integrally mounted to a single rotor shaft, the rotor shaft being rotated by a single motor.

BRIEF DESCRIPTION OF THE DRAWINGS

FIG. 2A is a plan view of the volute pump mechanism portion, and FIG. 2B is a sectional view of the volute pump mechanism portion of FIG. 2A.

DESCRIPTION OF THE PREFERRED EMBODIEMENTS

A vacuum pump according to an embodiment of the present invention will now be described in detail with reference to FIGS. 1 and 2.

Figure 1:
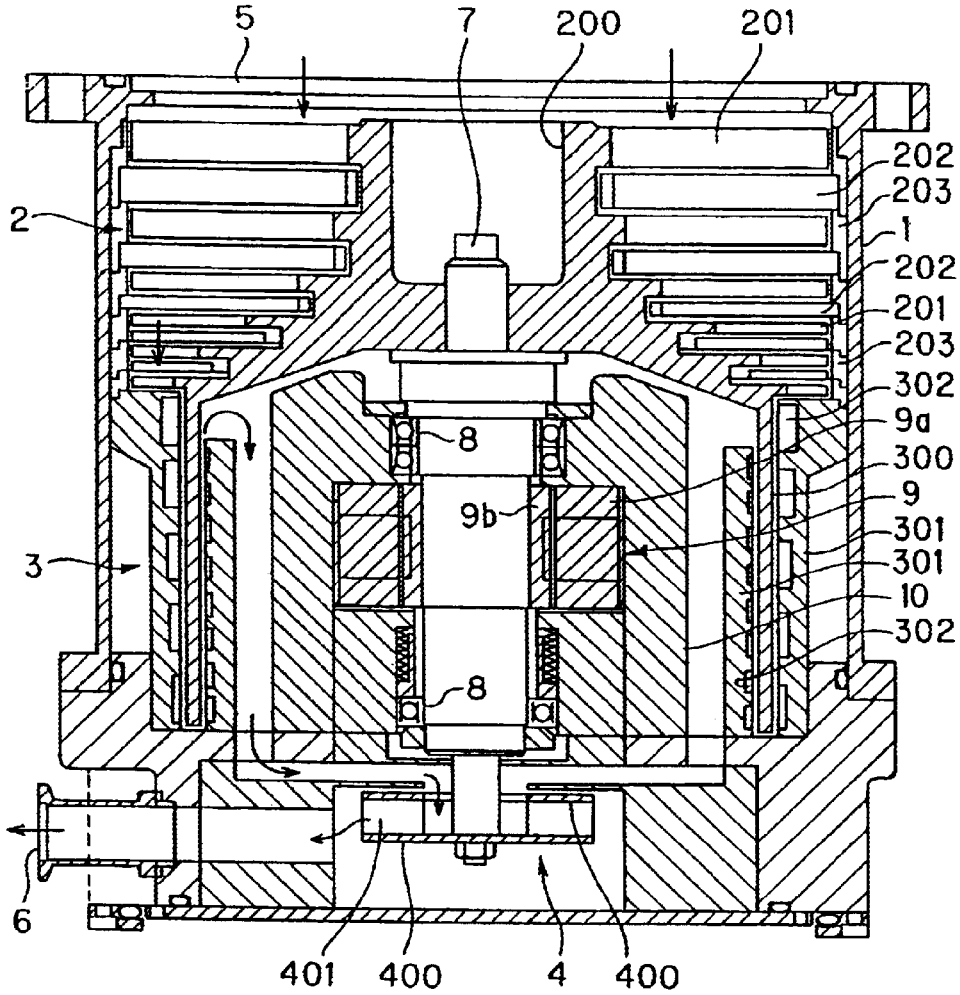
FIG. 1 is a sectional view of a vacuum pump according to an embodiment of the present invention.

The vacuum pump of this embodiment shown in FIG. 1 has a composite pump structure which contains in a single cylindrical pump case 1 three different pump mechanism portions: a turbo-molecular pump mechanism portion 2, a thread groove pump mechanism portion 3, and a volute pump mechanism portion 4.

On the upper portion side of the pump case 1, there is provided a gas inlet 5, and, on the lower portion side of the pump case 1, there is provided a gas outlet 6. On the gas inlet 5 side of the pump case 1, the turbo-molecular pump mechanism portion 2 is provided, and, on the gas outlet 6 side of the pump case 1, the volute pump mechanism portion 4 is provided. Further, between the turbo-molecular pump mechanism portion 2 and the volute pump mechanism portion 4, the thread groove pump mechanism portion 3 is provided. Further, the gas inlet 5 in the upper portion of the pump case 1 is connected to the high-vacuum side, for example, the process chamber of a semiconductor manufacturing apparatus, whereas the gas outlet 6 in the lower portion of the pump case 1 communicates with the atmosphere-side. That is, the vacuum pump of this embodiment adopts a sandwich structure in which the thread groove pump mechanism portion 3 is placed between the turbo-molecular pump mechanism portion 2 situated on the high-vacuum side and the volute pump mechanism portion 4 situated on the atmosphere side.

The turbo-molecular pump mechanism portion 2 has rotor blades 201 and stator blades 202 provided in an outer periphery of a rotatable cylindrical rotor 200, and the upper end of the rotor 200 is directed to the gas inlet 5 side. The rotor blades 201 and the stator blades 202 are alternately arranged along the rotation center axis of the rotor 200. While the rotor blades 201 are formed integrally with the rotor 200 and capable of rotating integrally with the rotor 200, the stator blades 202 are secured to the inner surface of the pump case 1 through the intermediation of spacers 203.

In the turbo-molecular pump mechanism portion 2, constructed as described above, it is possible to achieve a high vacuum (degree of vacuum: $10^{-5}$ Pa) by an evacuating operation of gas molecules through the interaction between the rotating rotor blades 201 and the stationary stator blades 202.

The thread groove pump mechanism portion 3 is composed of a rotatable cylindrical rotor 300 and thread groove spacers 301, and the rotor 300 of the thread groove pump mechanism portion 3 is formed integrally with the lower portion of the rotor 200 as the skirt of the turbo-molecular pump mechanism portion 2. Further, the rotor 300 of the thread groove pump mechanism portion 3 is formed coaxially with the rotor 200 of the turbo-molecular pump mechanism portion 2. The thread groove spacers 301 are respectively arranged on the inner and outer sides of the rotor 300. Thread grooves 302 are formed in the surfaces of the inner and outer thread groove spacers 301 opposed to the rotor 300.

Figure 2A:
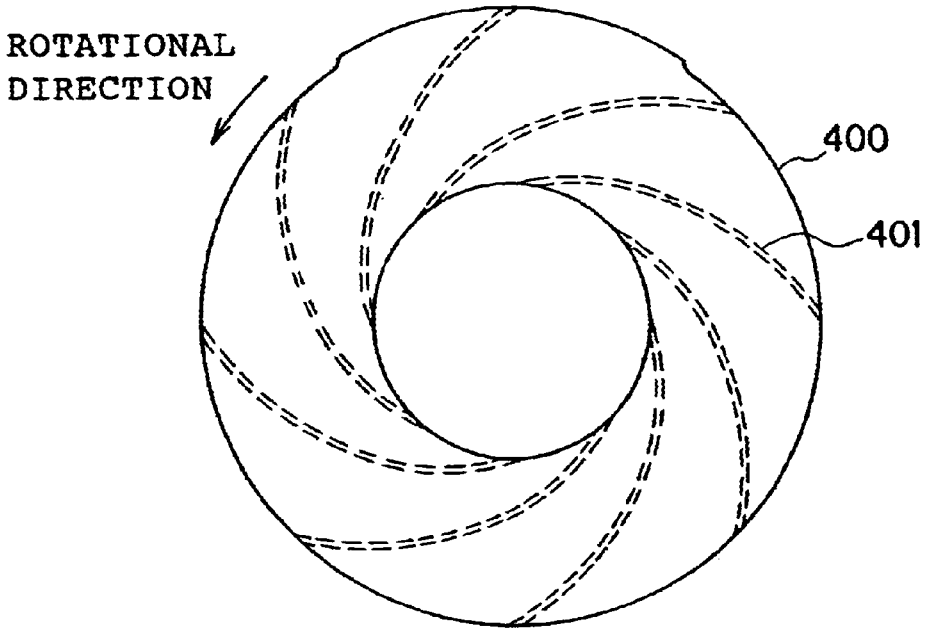
FIGS. 2A and 2B are diagrams illustrating a volute pump mechanism portion used in the vacuum pump of FIG. 1.
Figure 2B:
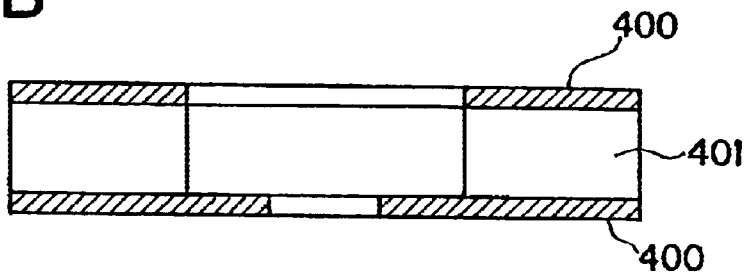

In the volute pump mechanism portion 4, a volute-shaped impeller 401 (hereinafter referred to as "the volute impeller") is provided between upper and lower rotating plates 400, 400. The rotation center axis of the integral unit composed of the rotating plates 400, 400 and the volute impeller 401 coincides with the rotation axes of the rotors 200 and 300 of the turbo-molecular pump mechanism portion 2 and the thread groove pump mechanism portion 3. As shown in FIG. 2A, the volute of the volute impeller 401 is directed toward the rotation center of the rotating plates 400.

A rotor shaft 7 is forced into the rotation center shaft of the rotor 200 of the turbo-molecular pump mechanism portion 2 and secured therein. Due to this joint structure of the rotor 200 and the rotor shaft 7, the rotor blades 201 on the outer peripheral surface of the rotor 200 are integrated with the rotor shaft 7.

The integral unit of the rotating plates 400 and the volute impeller 401 constituting the volute pump mechanism portion 4 is fastened to the lower end of the rotor shaft 7 by means of a screw. In this way, in this embodiment, the volute impeller 401 of the volute pump mechanism portion 4 is also integrally mounted to the rotor shaft 7 to which the rotor blades 201 are fastened.

The rotor 300 of the thread groove pump portion 3, which is provided integrally with the rotor 200 of the turbo-molecular pump mechanism portion 2, is integral with the rotor 200 of the turbo-molecular pump mechanism portion 2 and the rotor shaft 7.

Thus, when the rotor shaft 7 is rotated, the rotor 200 and the rotor blades 201 of the turbo-molecular pump mechanism portion 2, the rotor 300 of the thread groove pump portion 3, and the volute impeller 401 of the volute pump mechanism portion 4 are rotated at the same speed in synchronism with each other.

While various types of bearing means for the rotor shaft 7 are possible, this embodiment adopts a structure in which the rotor shaft 7 is supported by ball bearings 8.

Regarding the rotating means of the rotor shaft 7 also, it would be possible to adopt various types of rotating means. This embodiment adopts a structure in which the rotor shaft 7 is rotated by a single motor 9. More specifically, the motor 9 adopts a structure in which a motor stator 9*a* is mounted to a stator column 10 provided on the inner side of the rotor 300 of the thread groove pump mechanism portion 3 and in which a motor rotor 9*b* is arranged on the outer peripheral surface of the rotor shaft 7 opposed to the motor stator 9*b*.

Next, an example of the way the vacuum pump constructed as described above is used and its operation will be described with reference to FIG. 1. In the drawing, the arrows indicate the flow of exhaust gas in the vacuum pump.

The vacuum pump shown in the drawing can be used, for example, as a means for evacuating the process chamber of a semiconductor processing apparatus. In this case, the gas inlet 5 of the pump case 1 of this vacuum pump is connected to the process chamber side.

In the case of the vacuum pump, connected as described above, when an operation start switch (not shown) is turned on, the motor 9 operates, and, together with the rotor shaft 7, the rotor blades 201 of the turbo-molecular pump mechanism portion 2, the rotor 300 of the thread groove pump mechanism portion 3, and the volute impeller 401 of the volute pump mechanism portion 4 rotate at the same speed in synchronism with each other.

At the initial stage of the operation of this vacuum pump, the pressure inside the vacuum pump and the process chamber is close to the atmospheric pressure and the interior is in the viscous flow range, so that the rotor blades 201 of the turbo-molecular pump mechanism portion 2 provide resistance and the pump speed (the speed of the rotors 200 and 300) is not increased. At this stage, the thread groove pump mechanism portion 3 functions as a compression pump.

In this case, the gas in the process chamber flows into the pump case 1 through the gas inlet 5 of the pump case 1, and then passes through the gaps between the rotor blades 201 and the stator blades 202 of the turbo-molecular mechanism portion 2 before it moves to the thread groove pump mechanism portion 3 side. The gas which has moved to the thread groove pump mechanism portion 3 side is transmitted under pressure to the volute pump mechanism portion 4 side through the interaction between the rotating rotor 300 and the thread grooves 302 of the thread groove pump mechanism portion 3. Then, the gas transmitted under pressure to the volute pump mechanism portion 4 side is sent to the gas outlet 6 of the pump case 1 by the rotation of the volute impeller 401, and discharged to the exterior of the pump through the gas outlet 6 at atmospheric pressure.

When, as a result of the above evacuating operation, the degree of vacuum in the vacuum pump and the process chamber is increased, and the pump speed (the rotor speed) is raised, the evacuating operation of the gas molecular flow is efficiently conducted through the interaction between the rotating rotor blades 201 and the stationary stator blades 202 in the turbo-molecular pump mechanism portion 2.

That is, in the turbo-molecular pump mechanism portion 2, the uppermost rotor blade 201 rotating at high speed imparts a downward momentum to the gas molecule group entering through the gas inlet 5, and the gas molecules having this downward momentum are guided by the stator blade 202 and transmitted to the next-lower-stage rotor blade 201 side. Then, by repeating the imparting of momentum, the gas molecules move from the gas inlet 5 to the thread groove pump mechanism portion 3 side to effect evacuation.

Further, in the thread groove pump mechanism portion 3, the gas molecules moving thereto are compressed to be changed from an intermediate flow to a viscous flow by the interaction between the rotating rotor 300 and the thread grooves 302 before being transmitted to the volute pump mechanism portion 4 side. Further, the viscous-flow gas transmitted to the volute pump mechanism portion 4 side is sent to the gas outlet 6 of the pump case 1 by the rotation of the volute impeller 401, and discharged to the exterior of the pump through the gas outlet 6 as atmospheric pressure.

As described above, in the vacuum pump of this embodiment, the turbo-molecular pump mechanism portion 2 is arranged on the high vacuum side, and the volute pump mechanism portion 4 is arranged on the atmosphere side, the thread groove pump mechanism portion 3 being arranged between the turbo-molecular pump mechanism portion 2 and the volute pump mechanism portion 4, so that it is possible to efficiently create a high vacuum (degree of vacuum: $10^{-5}$ Pa) from the atmosphere by using a single unit of this vacuum pump.

Further, in the vacuum pump of this embodiment, the rotor blades 201 of the turbo-molecular pump mechanism portion 2, the rotor 300 of the thread groove pump mechanism portion 3, and the impeller 401 of the volute pump mechanism portion 4 are integrally mounted to one rotor shaft 7, and the rotor shaft 7 is rotated by a single motor 9, so that the number of parts of the pump drive system, including the rotor shaft 7 and the motor 9, is reduced, thereby achieving a reduction in the overall size and weight of a vacuum pump of this type.

Further, in the vacuum pump of this embodiment, it is possible to adopt a considerably small and light volute impeller 401 in the construction of the volute pump mechanism portion 4, whereby it is possible to achieve a reduction in the price of the entire vacuum pump, space saving, and energy saving in operation.

While in the above embodiment the ball bearings 8 are used as the bearing means for the rotor shaft 7, it is also possible to use a non-contact type bearing, such as a magnetic bearing, as this bearing means.

According to the present invention, the construction is employed, in which the turbo-molecular pump mechanism portion is arranged on the high vacuum side, the volute pump mechanism portion is arranged on the atmosphere side, and the thread groove pump mechanism portion is arranged between the turbo-molecular pump mechanism portion and the volute pump mechanism portions so that it is possible to provide a vacuum pump which makes it possible to perform evacuation efficiently from the atmosphere to a high vacuum (degree of vacuum: $10^{-5}$ Pa)by using a single pump unit. Further, in accordance with the present invention, the rotor blades of the turbo-molecular pump mechanism portion, the rotor of the thread groove pump mechanism portion, and the impeller of the volute pump mechanism portion are mounted to a single rotor shaft, and the rotor shaft is rotated by a single motor, so that the number of parts of the pump drive system, including the rotor shaft and the motor, is reduced, thereby achieving effects such as a reduction in the overall size and weight of a vacuum pump of this type.

What is claimed is:

1. A vacuum pump comprising:

a turbo-molecular pump mechanism portion for performing an evacuating operation through interaction between rotating rotor blades and stationary stator blades;

a thread groove pump mechanism portion for performing an evacuating operation through interaction between a rotating rotor and a thread groove; and a volute pump mechanism portion for performing an evacuating operation through rotation of a volute impeller;

wherein the turbo-molecular pump mechanism portion is arranged on a high vacuum side, the volute pump mechanism portion is arranged on an atmosphere side, and the thread groove pump mechanism portion is arranged between the turbo-molecular pump mechanism portion and the volute pump mechanism portion.

2. A vacuum pump according to claim 1, wherein the rotor blades of the turbo-molecular pump mechanism portion, the rotor of the thread groove pump mechanism portion, and the impeller of the volute pump mechanism portion are integrally mounted to a single rotor shaft, the rotor shaft being rotated by a single motor.

3. A vacuum pump according to claim 1, wherein the thread groove pump mechanism portion has a thread groove spacer arranged on the inner side of the rotor.

4. A vacuum pump according to claim 1, wherein the thread groove pump mechanism portion has a thread groove spacer arranged on each of the inner side and the outer side of the rotor.

5. A vacuum pump according to claim 1, wherein the thread groove pump mechanism portion has an upward flow portion on the thread groove.

6. A vacuum pump comprising: a turbo-molecular pump mechanism portion having rotatable rotor blades coacting with stationary stator blades for pumping gas from an enclosed space; a thread groove pump mechanism portion connected to receive the gas pumped by the turbo-molecular pump mechanism portion and having a rotatable rotor coacting with a thread groove for pumping the received gas; and a volute pump mechanism portion connected to receive the gas pumped by the thread groove pump mechanism portion and having a rotatable volute impeller for pumping and discharging the received gas.

7. A vacuum pump according to claim 6; further including a motor connected to rotationally drive the rotor blades, the rotor and the volute impeller.

8. A vacuum pump according to claim 7; wherein the motor comprises a single motor connected to rotationally drive a rotor shaft, the rotor shaft being connected to the rotor blades, the rotor and the volute impeller.

9. A vacuum pump according claim 7; wherein the turbo-molecular pump mechanism portion has a cylindrical rotor having an upper portion and a lower portion, the rotor blades being connected to and extending radially outwardly from the upper portion of the cylindrical rotor, and the lower portion of the cylindrical rotor comprising the rotor of the thread groove pump mechanism portion.

10. A vacuum pump according to claim 9; wherein the thread groove pump mechanism portion has a thread groove spacer disposed on one or both sides of the lower portion of the cylindrical motor.

11. A vacuum pump according to claim 10; further including a rotor shaft connected to be rotationally driven by a single motor, the cylindrical rotor and the volute impeller being connected to the rotor shaft for rotation therewith.

* * * * *